US006119377A

United States Patent [19]

Rubio

[11] Patent Number: 6,119,377

[45] Date of Patent: Sep. 19, 2000

[54] BACKHOE ATTACHMENT FOR SKID LOADERS

[76] Inventor: Melchisedec Rubio, P.O. Box 1351, Marble Falls, Tex. 78654

[21] Appl. No.: 09/266,279

[22] Filed: Mar. 11, 1999

[51] Int. Cl.[7] ..... E02F 3/96

[52] U.S. Cl. ..... 37/403; 414/685

[58] Field of Search ..... 37/442, 443, 466, 37/468, 404, 403; 414/685, 686, 695.7, 723, 912; 172/245–254

[56] References Cited

U.S. PATENT DOCUMENTS 4,808,061 2/1989 Cook et al. ..... 414/695.7
5,171,124 12/1992 Foster ..... 414/685
5,819,445 10/1998 LaBelle et al. ..... 37/404
5,895,199 4/1999 Baumert, III et al. ..... 414/686
5,954,471 9/1999 Cullen ..... 414/686

*Primary Examiner*—Robert E. Pezzuto
*Attorney, Agent, or Firm*—Russell D. Culbertson; Shaffer & Culbertson, LLP

[57] ABSTRACT

A backhoe attachment (10) includes a boom (12) adapted to be connected by a suitable mounting structure (15) to the loader manipulating arrangement (16) of a front-end or skid loader. A distal end of the boom (12) is adapted for receiving a backhoe bucket (14). When attached to the loader manipulating arrangement (16) the loader operator may use the loader's regular controls to pull the backhoe bucket (14) toward the loader and dig a trench with the attachment.

10 Claims, 4 Drawing Sheets

BACKHOE ATTACHMENT FOR SKID LOADERS

TECHNICAL FIELD OF THE INVENTION

This invention relates to excavation equipment and, more particularly, to a backhoe attachment for front-end/skid loaders.

BACKGROUND OF THE INVENTION

Front-end loaders are vehicles which include a loading bucket and a loader manipulating arrangement for manipulating the bucket. The loader manipulating arrangement is adapted to position the loading bucket along a vertical axis and to tilt or rotate the bucket about a rotational axis associated with the bucket. In operation, the loading bucket may be rotated to a level orientation, lowered to desired height, and then driven into a pile of material to scoop the material into the bucket. The now loaded bucket may then be raised along a vertical axis using the loader manipulating arrangement and the vehicle may be driven to a desired location for dumping the loaded material. When the vehicle is at the desired position, the loading bucket may be tilted or rotated downwardly to dump the load of material.

There are many varieties of front-end loaders, including small loaders referred to as "skid loaders". The 750 F-Series, BOBCAT brand loader manufactured by Melroe Company is an example of a skid loader. These skid loaders are commonly used for clearing construction sites or moving materials on such sites.

Numerous attachments have been developed for skid loaders in order to perform various tasks in addition to front-end loading tasks. For example, backhoe and trencher attachments are available for certain skid loader models. Prior backhoe attachments for skid loaders comprise segmented and articulated arms having a backhoe bucket connected at the end of the articulated arm. Prior trencher attachments comprise endless chain-type trencher machines adapted to dig a narrow trench as the chain-type mechanism is driven continuously along a track.

Although these attachments increased the tasks which could be accomplished with the skid loader, the attachments added complexity and cost. In particular, prior backhoe and trenching attachments required separate hydraulic actuators. These additional hydraulic actuators were commonly driven by the hydraulic power supply associated with the skid loader. Thus, the skid loader had to be specially designed to accommodate prior backhoe and trenching attachments. Also, prior backhoe attachments could be operated only by a skilled backhoe operator.

SUMMARY OF THE INVENTION

It is an object of the invention to provide a backhoe attachment which overcomes the above described problems associated with prior backhoe and trenching attachments for front-end/skid loaders. More particulary, it is an object of the invention to provide a backhoe attachment which requires no separate hydraulic actuators.

A backhoe attachment according to the invention includes a boom connected to the loader manipulating arrangement by a suitable attachment connecting means or structure. The boom comprises an elongated rigid member with a backhoe bucket connector positioned at a distal end. The backhoe bucket connector is adapted to rigidly fix a suitable backhoe bucket at the distal end of the boom.

With the backhoe attachment according to the invention secured to the loader manipulating arrangement, the loader manipulating arrangement may be operated to pull the backhoe bucket downwardly and toward the loader to scoop out soil. The movement may be repeated to dig a trench or otherwise excavate an area. Yet the backhoe attachment requires no separate hydraulic actuator. Furthermore, the trenching or excavating operation is performed using only the controls associated with the loader manipulating arrangement, and thus the operation does not require a regular backhoe operator.

A backhoe attachment according to the invention may be used to with any front-end/skid loader device having a loader manipulating arrangement. As used in this disclosure and the accompanying claims, a loader manipulating arrangement comprises an arrangement for moving an attachment along a vertical axis and also for tilting or rotating the attachment about a rotational axis. Also, although front-end/skid loader manufacturers use various connecting arrangements for connecting attachments to the loader manipulating arrangement, the invention is not limited to any particular connecting arrangement.

These and other objects, advantages, and features of the invention will be apparent from the following description of the preferred embodiments, considered along with the accompanying drawings.

DESCRIPTION OF THE PREFERRED EMBODIMENTS

Figure 1:
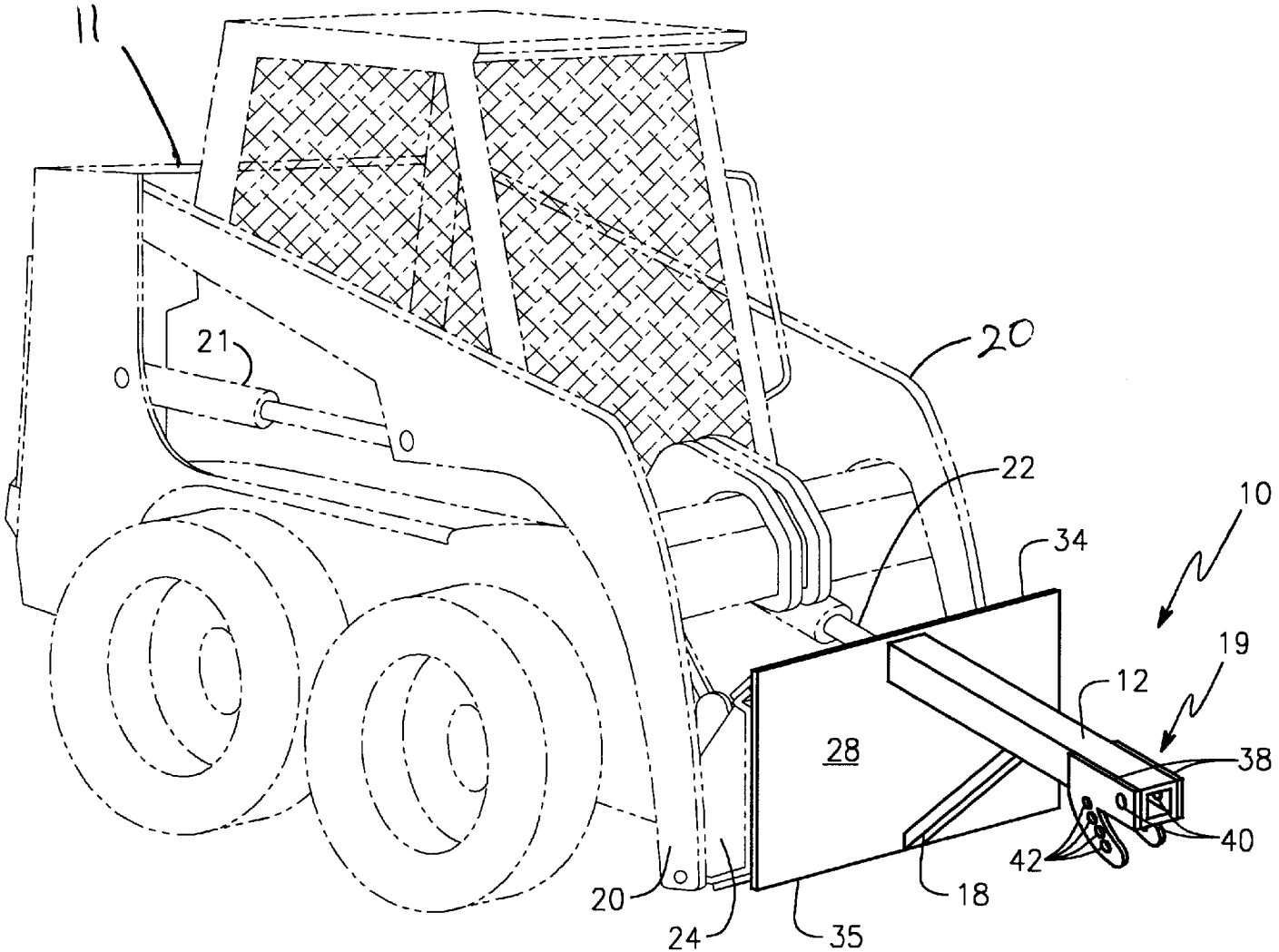
FIG. 1 is an isometric view of a backhoe attachment embodying the principles of the invention, attached to a skid loader shown in phantom, and with the backhoe bucket removed to show the preferred bucket connector arrangement.

A backhoe attachment 10 embodying the principles of the invention includes a boom 12 having a distal end adapted to receive a backhoe bucket 14. The opposite or proximal end of the boom 12 is connected to a mounting structure shown generally at reference numeral 15 for connecting the boom to a loader manipulating arrangement shown generally at reference numeral 16, associated with a loader 11. The illustrated form of the invention also includes a boom support member 18 and a bucket connector structure shown generally at reference numeral 19.

Figure 2:
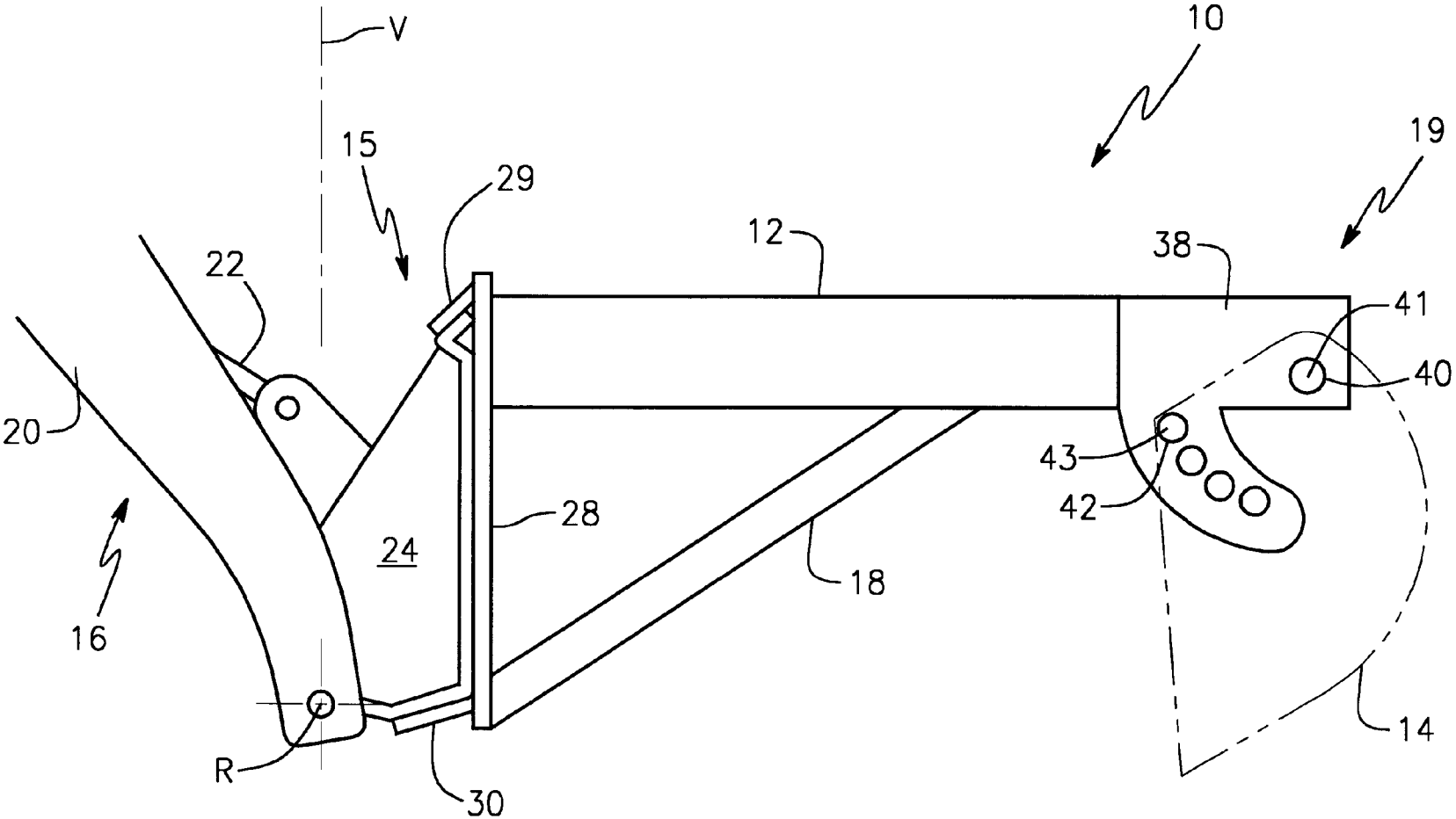
FIG. 2 is a side view of the backhoe attachment and a portion of the skid loader shown in FIG. 1, with the backhoe bucket shown in phantom.
Figure 3:
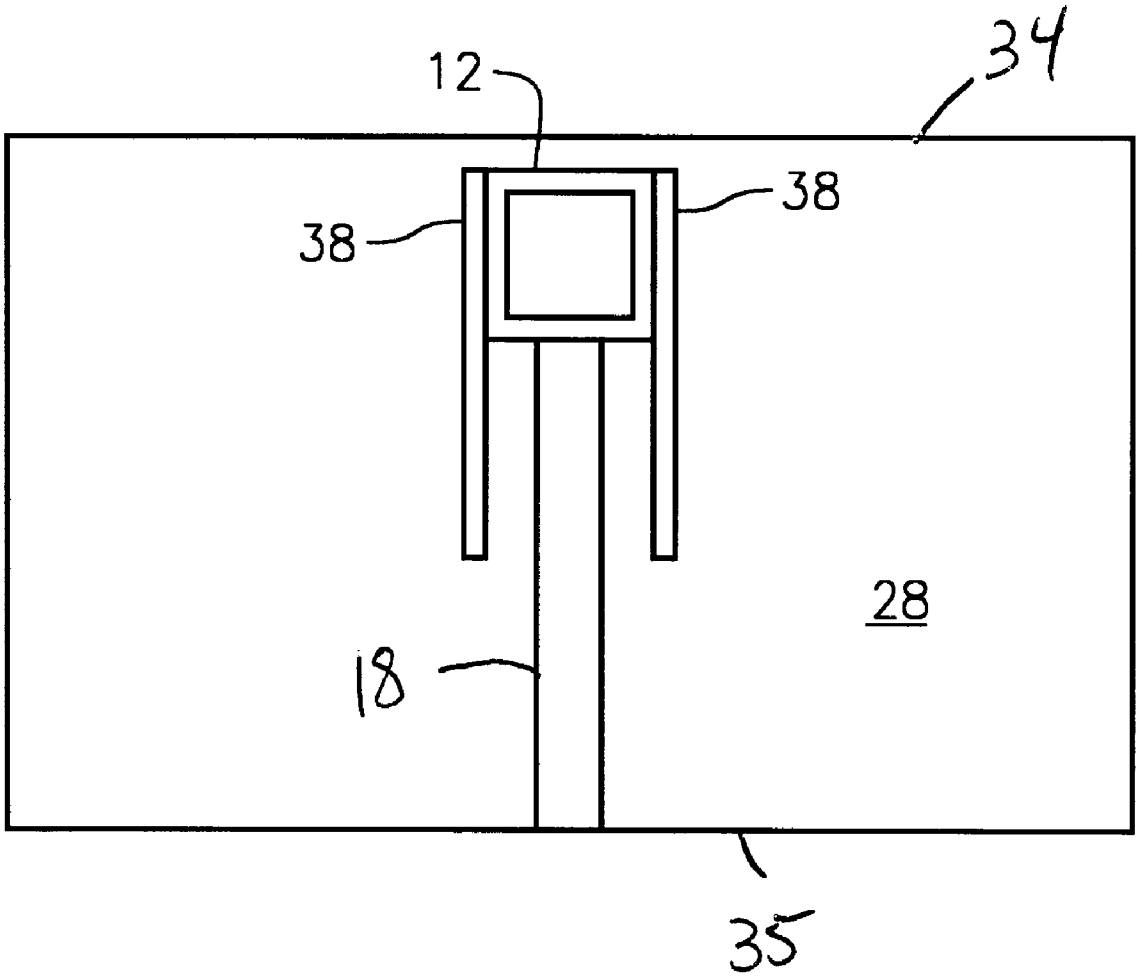
FIG. 3 is an end view of the backhoe attachment with the backhoe bucket removed.
Figure 4:
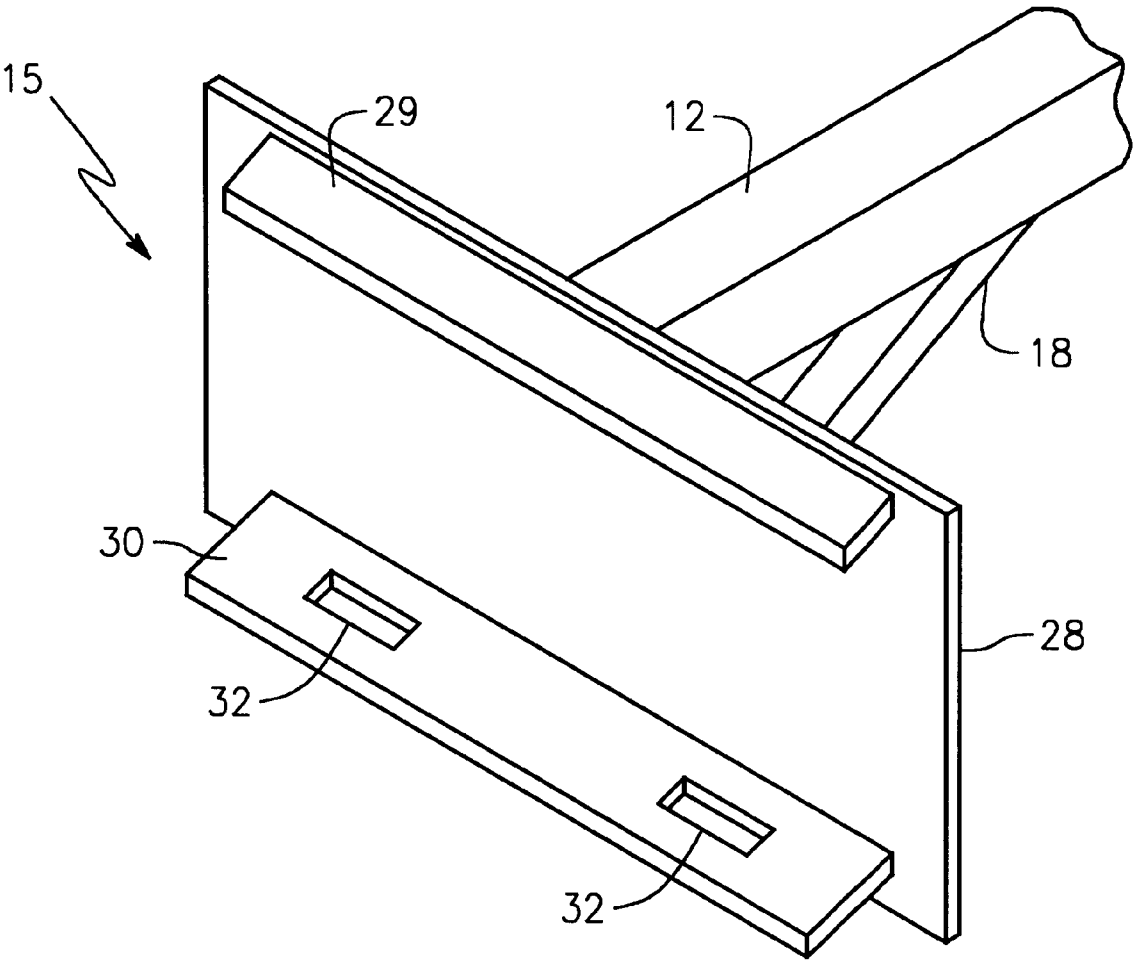
FIG. 4 is an isometric view showing the side of the backhoe attachment which connects to a front-end/skid loader.

Referring particularly to FIG. 1, the loader manipulating arrangement 16 may include two spaced apart arms 20. Arms 20 are adapted to be raised or lowered in unison by hydraulic actuators 21. Loader manipulating arrangement 16 also includes a bucket pivoting or tilting arrangement including pivot actuator 22. Referring now to FIG. 2, the loader manipulating arrangement 16 is adapted to move an attachment along a vertical axis V, and also to rotate the attachment about a rotational axis R. It will be noted that since the illustrated attachment moves on pivoting arms 20, the attachment actually moves along an arc, and that movement along vertical axis V in this disclosure means movement which changes the relative height of the attachment with respect to the vertical axis V. In any event, the particular style of loader manipulating arrangement 16 shown in the figures is simply one arrangement and other loaders may have alternate loader manipulating arrangements. For example, some skid loaders include two pivot actuators for rotating the attachment rather than the single actuator 22 shown in FIG. 1. A backhoe attachment according to the invention may be used with any front-end or skid loader having a loader manipulating arrangement that at least allows the vertical/height positioning and rotational positioning shown in FIG. 2.

A number of alternate mounting structures may be used for rigidly connecting boom 12 to the loader manipulating arrangement 16. The illustrated loader manipulating arrangement is connected to an attachment receiver 24 to which various attachments may be connected. However, those skilled in the art will appreciate that a backhoe attachment according to the invention may be connected directly to the loader manipulating arrangement with no intermediate structure such as attachment receiver 24. Such a direct connection to the loader manipulating arrangement is to be considered in an equivalent to the illustrative mounting arrangement shown in the figures.

The illustrated in mounting structure 15 includes an attachment base 28, and a receiver connecting structure including an upper flange 29 and a lower flange 30. Both the upper and lower flanges, 29 and 30, respectively, extend from the side of base 28 opposite the side to which boom 12 is connected. Lower flange 30 includes openings 32, each opening for receiving a wedge projection (not shown) associated with the attachment receiver 24. This particular receiver connecting structure is compatible with the BOBTACH brand connecting system used in BOBCAT brand skid loaders manufactured by Melroe Company. In alternate forms of the invention, the base may include an arrangement for connecting to an alternate attachment receiver or for connecting directly to the loader manipulating arrangement arms 20 and pivot actuator 22.

In the preferred form of the invention shown in the drawings, the proximal end of boom 12 is rigidly connected near the top edge 34 of attachment base 28. Boom support member 18 connects near the bottom edge 35 of attachment base 28 and extends to a point on boom 12 removed from the boom proximal end. Boom support member 18 is included in the preferred form of invention for providing additional support for boom 12. Boom 12 may, for example, be on the order of 48 inches in length. However, other forms of the invention may include no such support member. In any event, the boom 12 and any associated boom support member 18 may be made from any suitable rigid material such as a suitable steel.

The bucket connecting structure 19 at the distal end of the boom 12 may comprise any suitable arrangement for rigidly connecting backhoe bucket 14 (FIG. 2) to the boom. The connecting structure 19 shown for purposes of example in the figures includes two spaced apart connector plates 38, one fixed on either side of boom 12. Each connector plate 38 includes a primary opening 40 adapted to receive a primary pin 41 associated with backhoe bucket 14. Each plate 38 also includes several secondary openings 42. Each set of secondary openings 42 is adapted to receive a secondary mounting pin 43 associated with the backhoe bucket. Several sets of secondary openings 42 are provided to allow bucket 14 to be connected at several different angles to the boom 12.

A detachable backhoe bucket 14 is shown in the figures in order to illustrate the preferred form of the invention. However, a backhoe bucket may be permanently attached to the distal end of the boom 12 within the scope of the invention.

In operation, backhoe attachment 10 is connected to the loader manipulating arrangement 16 has shown in FIGS. 1 and 2. The loader arms 20 are first raised in order to raise the attachment 10 to level above grade, but somewhat lower than the length of the boom. From this position, backhoe attachment 10 is rotated clockwise about axis R to pull the backhoe bucket 14 toward the loader and eventually through the soil. Attachment 10 may need to be either raised further or lowered simultaneously with this clockwise rotation. In any event, the pulling movement through the soil fills bucket 14. Once bucket 14 is full, attachment 10 is raised to clear the resulting trench, and then the skid loader 11 is turned so that the boom extends out over an area adjacent to the trench. At this point, attachment 10 may be rotated counterclockwise about rotational axis R to dump the contents of backhoe bucket 14. The loader operator may then turn the loader so as to move boom 12 back over the trench to repeat these steps. Thus, the attachment allows a loader operator to quickly excavate a trench, using only the hydraulic actuators of the loader manipulating arrangement 16.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A backhoe attachment for use with devices having a loader manipulating arrangement, the backhoe attachment comprising:

(a) an attachment base;

(b) a connecting structure associated with the attachment base for connecting the attachment base to the loader manipulating arrangement;

(c) a boom having a proximal end rigidly connected to the attachment base and having a distal end extending from the attachment base; and (d) a backhoe bucket connector at the distal end of the boom for receiving a backhoe bucket and rigidly fixing the backhoe bucket to the boom, the backhoe bucket connector including a primary opening at the distal end of the boom for receiving a primary pin associated with the backhoe bucket, and further including a plurality of secondary openings aligned in an arc about the primary opening and spaced apart from the primary opening toward the proximal end of the boom, each secondary opening for receiving a secondary pin associated with the backhoe bucket.

2. The apparatus of claim 1 wherein the connecting structure includes:

(a) a top angled extension extending from a side of the attachment base opposite to the boom;

(b) a bottom angled extension extending from the side of the attachment base opposite to the boom; and (c) a plurality of locking openings spaced apart on the bottom angled extension.

3. The apparatus of claim 1 further comprising:

(a) a fixed-length boom support member connected between a lower edge of the attachment base and the boom at a point between the distal end and proximal end of the boom, and wherein the proximal end of the boom is connected to a top edge of the attachment base.

4. A backhoe attachment for use with devices having a loader manipulating arrangement, the backhoe attachment comprising:

(a) an attachment base;

(b) a connecting structure associated with the attachment base for connecting the attachment base to the loader manipulating arrangement;

(c) a boom having a proximal end rigidly connected to a top edge of the attachment base and having a distal end extending from the attachment base;

(d) a backhoe bucket connected at the distal end of the boom; and (e) a fixed-length boom support member connected between a lower edge of the attachment base and the boom at a point between the distal end and proximal end of the boom.

5. The apparatus of claim 4 wherein the connecting structure includes:

(a) a top angled extension extending from a side of the attachment base opposite to the boom;

(b) a bottom angled extension extending from the side of the attachment base opposite to the boom; and (c) a plurality of locking openings spaced apart on the bottom angled extension.

6. The apparatus of claim 4 wherein the backhoe bucket is connected to the distal end of the boom with a bucket connector which includes:

(a) a primary opening at the distal end of the boom for receiving a primary pin associated with the backhoe bucket; and (b) a plurality of secondary openings aligned in an arc about the primary opening and spaced apart from the primary opening toward the proximal end of the boom, each secondary opening for receiving a secondary pin associated with the backhoe bucket.

7. A backhoe attachment for use with devices having a loader manipulating arrangement, the backhoe attachment comprising:

(a) attachment connecting means for connecting the backhoe attachment to the loader manipulating arrangement;

(b) a boom having a proximal end rigidly connected to the backhoe attachment connecting means and having a distal end extending from the backhoe attachment connecting means;

(c) a backhoe bucket connector having a primary opening at the distal end of the boom for receiving a primary pin associated with a backhoe bucket, and further having a plurality of secondary openings aligned in an arc about the primary opening and spaced apart from the primary opening toward the proximal end of the boom, each secondary opening for receiving a secondary pin associated with the backhoe bucket.

8. The apparatus of claim 7 wherein the backhoe attachment connecting means comprises:

(a) an attachment base; and (b) a connecting structure associated with the attachment base for connecting the attachment base to the loader manipulating arrangement.

9. The apparatus of claim 8 wherein the connecting structure includes:

(a) a top angled extension extending from a side of the attachment base opposite to the boom;

(b) a bottom angled extension extending from the side of the attachment base opposite to the boom; and (c) a plurality of locking openings spaced apart on the bottom angled extension.

10. The apparatus of claim 7 further comprising:

(a) a fixed-length boom support member connected between a lower edge of the attachment base and the boom at a point between the distal end and proximal end of the boom, and wherein the proximal end of the boom is connected to a top edge of the attachment base.

* * * * *